United States Patent [19]

Schut

[11] Patent Number: 5,022,361

[45] Date of Patent: Jun. 11, 1991

[54] VALVE-LASH ADJUSTMENT SYSTEM

[75] Inventor: Jan Schut, Luxembourg, Luxembourg

[73] Assignee: General Motors Corporation, Detroit, Mich.

[21] Appl. No.: 607,943

[22] Filed: Oct. 31, 1990

[30] Foreign Application Priority Data

Nov. 11, 1989 [GB] United Kingdom ..... 8925541

[51] Int. Cl.[5] ..... F01L 1/24

[52] U.S. Cl. ..... 123/90.55; 123/90.58

[58] Field of Search ..... 123/90.48, 90.49, 90.52, 123/90.55, 90.57, 90.58

[56] References Cited

U.S. PATENT DOCUMENTS

| | | | |
|---|---|---|---|
| 2,109,815 | 3/1938 | Best | 123/90.58 |
| 3,728,990 | 4/1973 | Lampredi et al. | 123/90.57 |
| 4,610,225 | 9/1986 | Camosso et al. | 123/90.55 |
| 4,632,075 | 12/1986 | Camosso et al. | 123/90.55 |
| 4,649,875 | 3/1987 | Mirone et al. | 123/90.55 |
| 4,662,324 | 5/1987 | Titolo | 123/90.55 |
| 4,662,325 | 5/1987 | Okabe et al. | 123/90.55 |
| 4,716,867 | 1/1988 | Speil | 123/90.55 |
| 4,779,583 | 10/1988 | Laffter et al. | 123/90.55 |

FOREIGN PATENT DOCUMENTS

| | | | |
|---|---|---|---|
| 0244558 | 11/1987 | European Pat. Off. . | |
| 0267631 | 5/1988 | European Pat. Off. . | |
| 0301267 | 2/1989 | European Pat. Off. . | |
| 0200005 | 11/1984 | Japan | 123/90.58 |
| 2093940 | 9/1982 | United Kingdom | 123/90.55 |
| 2127928 | 4/1984 | United Kingdom . | |

*Primary Examiner*—David A. Okonsky
*Assistant Examiner*—Weilun Lo
*Attorney, Agent, or Firm*—Robert J. Outland

[57] ABSTRACT

The valve-lash adjustment system 10 includes a load-carrying spacer means 82 adjacent the hydraulic valve-lash assembly which is interposed between said hydraulic valve-lash assembly and said free end 12 of the valve stem, the thickness of said load-carrying spacer means 82 being such as to compensate substantially for said mechanical tolerances between said valve and said associated engine components, so that, during engine operation, said hydraulic valve-lash adjuster assembly adjusts the overall length thereof within a limited range of distances required to compensate for said thermal expansion/contraction between the valve and said associated engine components, and, in the event of a failure in supply of hydraulic fluid to said hydraulic valve-lash adjuster assembly, said hydraulic valve-lash adjuster assembly will only decrease in overall length by an amount falling within said limited range of distances.

17 Claims, 3 Drawing Sheets

VALVE-LASH ADJUSTMENT SYSTEM

This invention relates to valve-lash adjustment systems for motor vehicle engines. In particular, it relates to valve-lash adjustment systems which include a hydraulic valve-lash adjuster assembly designed to be positioned between a free end of a valve stem of a spring-loaded valve of the engine and a movable cam surface so as to compensate for mechanical tolerances originating from manufacturing methods and for valve lash changes due to thermal expansion/contraction of the valve and associated engine components.

Hydraulic valve-lash adjusters for use in compensating for valve lash generated during the operation of valve trains in overhead cam-operated internal combustion engines have been known for many years. Many different designs of such hydraulic valve-lash adjusters have been described in the prior art, but, in general, they all comprise a reciprocably movable cylinder body, a piston slidably mounted in said cylinder body to define therebetween a high-pressure, variable-volume chamber filled with hydraulic fluid, a resilient biasing means which biases said piston away from said cylinder, and a one-way valve-controlled passage in said piston connecting said high-pressure chamber to a low-pressure chamber which contains hydraulic fluid and is located within a tappet housing, which tappet housing contains said hydraulic valve-lash adjuster. Such hydraulic valve-lash adjusters operate by extending in overall length so as to occupy substantially all of the distance existing between a free end of a valve stem of an engine valve and a movable cam surface associated with that valve, when that engine valve is in a closed position. During the extension of the hydraulic valve-lash adjuster to do this, the one-way valve in the piston opens to allow flow of hydraulic fluid from the low-pressure chamber into the high-pressure chamber until the high-pressure chamber is full of hydraulic fluid and the pressures between the low-pressure chamber and the high-pressure chamber equalize.

The engine valve is opened by the movable cam surface exerting a thrust pressure on the free end of the valve stem, via the hydraulic valve-lash adjuster, which is sufficient to overcome a valve spring retaining the engine valve in its closed position. The thrust pressure exerted by the movable cam surface on a contact surface of the tappet housing initially causes the hydraulic valve-lash adjuster to start to contract, due to movement of the piston in the cylinder against the resilient bias of the resilient biasing means. This initial movement causes the pressure in the high-pressure chamber to rise and the one-way valve to close. Further contraction of the hydraulic valve-lash adjuster effectively ceases, and the adjuster reacts as if it were a solid member, and transfers the thrust pressure exerted by the movable cam surface to the free end of the valve stem of the engine valve.

It is customary practice in these hydraulic valve-lash adjusters to arrange for a controlled "leak-down" of hydraulic fluid to occur between the high-pressure chamber and the low-pressure chamber of the adjuster while the one-way valve is in its closed position. This ensures that, when the thrust pressure exerted by the movable cam member ceases, the engine valve can close tightly without being obstructed in its movement by the hydraulic valve-lash adjuster. Once the thrust pressure exerted by the movable cam member on the hydraulic valve-lash adjuster ceases, the resilient biasing member between the piston and the cylinder of the adjuster causes the piston to move outwardly in the cylinder to extend the overall length of the adjuster, which movement, in turn, causes the one-way valve to open and hydraulic fluid to flow from the low-pressure chamber to the high-pressure chamber of the adjuster.

In many of the hydraulic valve-lash adjusters used in motor vehicle engines, the hydraulic fluid used in the adjuster is derived directly from the engine oil used in the lubricating system of the engine, and the tappet housing containing the adjuster contains oil passages or galleries formed therein to direct a supply of engine oil into the low-pressure chamber of the adjuster during operation of the engine. This sort of operating arrangement has three potential disadvantages. First, there is a risk that air can become entrained in the engine oil entering the low-pressure chamber of the hydraulic valve-lash adjuster which, if conveyed into the high-pressure chamber of the adjuster during operation thereof, can cause partial collapse of the adjuster under the thrust pressure exerted by the movable cam surface, and thus incomplete opening of the associated engine valve. Second, the oil may tend to drain from the hydraulic valve-lash adjuster while the engine is stationary for any protracted time, such as overnight, and there is a risk that initially the adjuster will lack the oil required for effective operation once the engine is re-started, until the oil supply to the adjuster is restored by circulation of the engine oil in the lubricating system of the engine. Consequently, the hydraulic valve-lash adjuster initially may not compensate fully for the valve lash generated, and this will create undesirable mechanical noise from the engine. Third, any engine valve that is in an open position while the engine is stationary tends to close under the spring bias exerted on that valve. Consequently the hydraulic fluid trapped in the high-pressure chamber of the adjuster for that valve will, gradually, leak back to the low-pressure chamber. The high-pressure chamber may then lack the oil required for effective operation when the engine is re-started, and undesirable mechanical noise will be created.

In order to overcome the first two mentioned disadvantages, there have been many designs of hydraulic valve-lash adjusters devised in which the low-pressure chamber of the adjuster is formed as a variable-volume, sealed chamber filled with hydraulic fluid that is free from any entrained gases and preferably possesses a viscosity that is stable over the range of operating temperatures experienced by the assembly during engine operation. Such hydraulic valve-lash adjusters are known as "self-contained" valve-lash adjusters. Many of these prior designs of self-contained valve-lash adjusters involve the use of resilient convoluted diaphragms formed from metal or elastomeric materials, which diaphragms are required to flex backwards and forwards, or to stretch and contract, in order to provide the variable-volume low-pressure chamber required in the adjuster. In general, the overall valve lash which needs compensating in an average valve train of a motor vehicle engine, as a result of mechanical tolerances in the valve train and of thermal expansion/contraction effects produced during engine operation, is of the order of 2 mm. Thus, in order for such a self-contained valve-lash adjuster to compensate for such an overall valve lash, it could be necessary for the overall length of the adjuster to vary by up to 3 mm, as the adjuster, before being installed in an engine, will, under the effect of the resilient biasing member, extend to a length at which this member ceases to extend any further, and the diaphragm thereof to be capable of such a degree of movement.

In the event that the diaphragm of such a self-contained valve-lash adjuster should fail during operation of the adjuster, then the adjuster would lose the hydraulic fluid from the variable-volume low-pressure chamber and would become ineffective in compensating for the aforesaid overall valve lash. This could result in the generation of heavy mechanical noise in the valve train, incomplete opening of the associated engine valve by the adjuster, and eventual mechanical damage to the valve train. The present invention substantially avoids such catastrophic effects on the valve train in the event of failure of a hydraulic valve-lash adjuster of the invention.

A valve-lash adjustment system according to the present invention, for use in a motor vehicle engine, and which is designed to be positioned between a free end of a valve stem of a spring-loaded valve of the engine and a movable cam surface so as to compensate, when the engine is operating, for any valve lash generated between said valve and said movable cam surface due to thermal expansion/contraction and/or mechanical tolerances between said valve and associated engine components, includes a hydraulic valve-lash adjuster assembly comprising a reciprocably movable cylinder body, a piston slidably mounted in said cylinder body to define therebetween a high-pressure, variable-volume chamber filled with hydraulic fluid, a resilient biasing means which biases said piston away from said cylinder body, a one-way valve-controlled passage in said piston connecting said high-pressure chamber to a low-pressure chamber which contains hydraulic fluid and is located within a tappet housing, which tappet housing contains said hydraulic valve-lash adjuster assembly and includes a contact surface engageable with said movable cam surface, said hydraulic valve-lash adjuster assembly being capable of adjusting the overall length thereof during engine operation to substantially eliminate said valve lash, is characterized in that the valve-lash adjustment system includes a load-carrying spacer means adjacent the hydraulic valve-lash adjuster assembly which is interposed between said hydraulic valve-lash adjuster assembly and either said free end of the valve stem or said movable cam surface, the thickness of said load-carrying spacer means being such as to compensate substantially for said mechanical tolerances between said valve and said associated engine components, so that, during engine operation, said hydraulic valve-lash adjuster assembly adjusts the overall length thereof within a limited range of distances required to compensate for said thermal expansion/contraction between the valve and said associated engine components, and, in the event of a failure in supply of hydraulic fluid to said hydraulic valve-lash adjuster assembly, said hydraulic valve-lash adjuster assembly will only decrease in overall length by an amount falling within said limited range of distances.

Preferably said load-carrying spacer means comprises a metal shim which is inserted between said hydraulic valve-lash adjuster assembly and said free end of the valve stem. Advantageously said hydraulic valve-lash adjustment assembly is provided with retention means for said metal shim.

Preferably the thickness of the load-carrying spacer means is in the range of 1 to 3 mm, and said limited range of distances through which the hydraulic valve-lash adjuster assembly operates is 0.1 to 0.3 mm.

A preferred embodiment of the present invention includes a self-contained hydraulic valve-lash adjuster assembly in which said low-pressure chamber in the tappet housing is a variable-volume sealed chamber filled with hydraulic fluid, and the resilient biasing means between the piston and the cylinder body of the hydraulic valve-lash adjuster assembly is positioned outside said variable-volume high-pressure chamber and forms part of said low-pressure chamber.

In one preferred embodiment of the invention, the resilient biasing means comprises a spring chamber formed from two Belleville springs arranged in opposition to one another with the outer peripheries thereof sealed to one another.

In a second preferred embodiment of the invention, the resilient biasing means comprises a resilient elastomeric annular ring positioned in sealing engagement with respective opposed surfaces formed on said piston and said cylinder body, and retained therein by a plurality of spring retainer clips spaced circumferentially around said annular ring and engaging respective abutments formed on said piston and said cylinder body.

The one-way valve in the hydraulic valve-lash adjuster assembly in one embodiment of the invention is a ball valve.

In another embodiment of the invention, the one-way valve in the hydraulic valve-lash adjuster assembly is a plate valve, which is slidably mounted for reciprocal movement on a central guide post which extends perpendicular to a flat surface of the plate valve, said guide post being mounted within said variable-volume, high-pressure chamber.

The invention and how it may be performed are hereinafter particularly described with reference to the accompanying drawings, in which.

Figure 1:
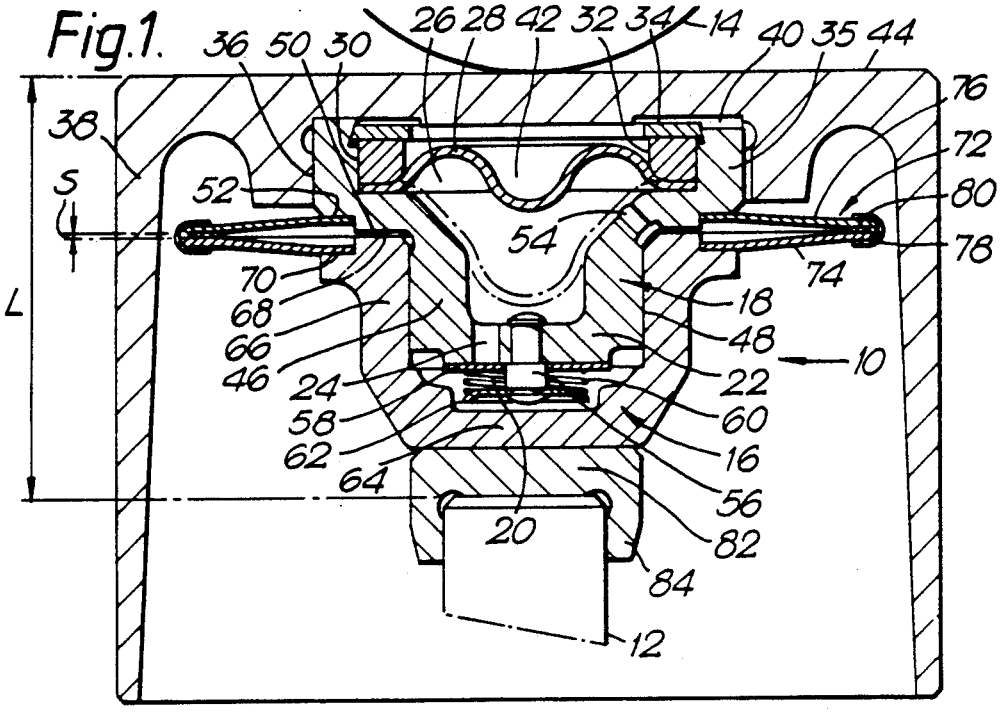
FIG. 1 shows a side view in cross-section of one embodiment of the present invention.

FIG. 1 shows a cross-sectional view through one embodiment of a valve-lash adjustment system 10 according to the present invention, interposed between a free end 12 of a valve stem of a spring-loaded valve of a motor vehicle engine and a movable cam surface 14 of that motor vehicle engine. The movable cam surface 14 is part of an eccentric cam which is rotatable on a driven cam shaft (not shown) so as to cause reciprocation of the spring-loaded valve against the spring bias thereof in order to open and close said valve, in a manner well-known in the art. With the valve in its closed position and the non-eccentric portion of the eccentric cam opposite thereto, the total distance L between the free end 12 of the valve stem and the movable cam surface 14 is preferably of the order of 17.5 mm.

The valve-lash adjustment system 10 includes a self-contained hydraulic valve-lash adjuster assembly which comprises a reciprocably movable cylinder body 16, and a cup-shaped piston 18 slidably mounted in said cylinder body 16 to define therebetween a high-pressure, variable-volume chamber 20. A base portion 22 of the piston 18 is provided with a through passage 24 which connects the high-pressure, variable-volume chamber 20 with a low-pressure, variable-volume chamber 26 within the cup-shaped piston 18 which is closed with a flexible diaphragm 28. The high-pressure chamber 20, the through passage 24 and the low-pressure chamber 26 are all completely filled with a suitable hydraulic fluid, such as a silicone oil. Flexible diaphragm 28 is retained in place within a stepped bore 30 in cup-shaped piston 18 by means of a resilient annular ring 32, which ring 32 is sealingly secured within the bore 30 by means of a circlip 34 which is snapped into position within an upper portion of the bore 30. An upper end 35 of the cup-shaped piston 18 which encircles the stepped bore 30 is secured within a central circular recess 36 formed within a tappet housing 38 which surrounds the valve-lash adjustment system 10. The recess 36 is provided with a passage 40 which extends from a chamber 42 defined between the flexible diaphragm 28 and the recess 36 to the interior of tappet housing 38, so as to vent chamber 42 to atmosphere. Tappet housing 38 is provided with a hardened contact surface 44 which is retained in wiping contact with the movable cam surface 14 by the valve-lash adjustment system 10, as will be described in more detail hereinafter.

Cup-shaped piston 18 is of a hollow, step-shaped configuration comprising the base portion 22, a cylindrical mid-section 46 which is slidably mounted within a bore 48 in cylinder body 16, a first annular shoulder 50 extending outwards from said mid-section 46, and a second, stepped, annular shoulder 52 extending outwards from the perimeter of said first annular shoulder and forming a base of the upper end 35 of the piston 18. The sliding fit of mid-section 46 in bore 48 is such that there is sufficient clearance therebetween to allow a predetermined "leak-down" of hydraulic fluid to occur between the piston 18 and the cylinder 16, as will be described in more detail hereinafter. A passage 54 is provided at the juncture between the mid-section 46 and the first annular shoulder 50 to allow this "leak-down" of hydraulic fluid to return to low-pressure chamber 26. The base portion 22 of piston 18 is provided with a co-axial guide post 56 which extends downwards into the high-pressure chamber 20. Slidably mounted upon guide post 56 is an annular plate valve 58, which is spring-biased into contact with the base portion 22 by means of a coil spring 60 which encircles guide post 56 and is retained thereon by means of an annular spring retainer 62 secured to the free end of guide post 56. Annular plate valve 58, when in contact with the base portion 22, effectively seals passage 24, and thus acts as a one-way valve between high-pressure chamber 20 and low-pressure chamber 26.

Cylinder body 16 is also of a hollow, step-shaped configuration comprising a flat base portion 64, a cylindrical mid-section 66 which contains bore 48, a first annular shoulder 68 extending outwards from said mid-section 66 and facing the first annular shoulder 50 of piston 18, and a second, stepped, annular shoulder 70 extending outwards from the perimeter of said first annular shoulder 68 and facing the second annular shoulder 52 of piston 18.

Piston 18 is sealingly coupled to cylinder body 16 by means of a spring chamber arrangement 72 which comprises two Belleville spring washers 74, 76 secured back-to-back around the outer peripheries thereof by a crimped annular collar 78, there being a resilient annular seal 80 located between said outer peripheries to seal the spring chamber arrangement 72. The inner periphery of the upper Belleville spring washer 76 is sealed to the second, stepped, annular shoulder 52 of piston 18, and the inner periphery of the lower Belleville spring washer is sealed to the second, stepped, annular shoulder 70 of cylinder body 16. The spring chamber arrangement 72 functions to bias piston 18 away from cylinder body 16, so ensuring that the valve-lash adjustment system 10 self-adjusts in length to take up the available distance between the free end 12 of the valve stem and the movable cam surface 14 during opening and closing of the associated valve while the motor vehicle engine is in operation.

Interposed between the flat base portion 64 of the cylinder body 16 and the free end 12 of the valve stem is a load-carrying spacer means in the form of a hardened metal shim 82. Shim 82 is formed with a depending annular rim 84 which defines a circular recess in the shim 82 which is so dimensioned that the shim 82 is a push-fit upon the free end 12 of the valve stem. The thickness of shim 82 is chosen so as to compensate for whatever mechanical tolerance exists between the valve with the free end 12 and the associated movable cam surface 14, which mechanical tolerance is determined at the time of assembling or maintaining the respective motor vehicle engine. This mechanical tolerance usually lies in the range of 1 to 2 mm.

Figure 3:
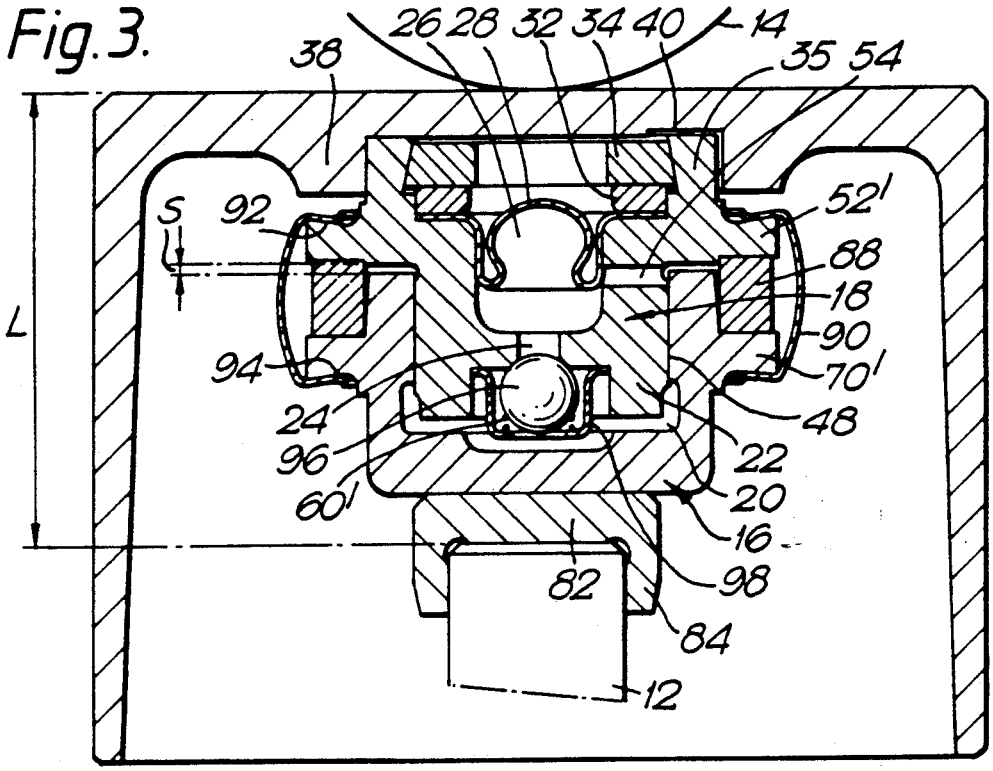
FIG. 3 shows a side view in cross-section of a second embodiment of the present invention.
Figure 5:
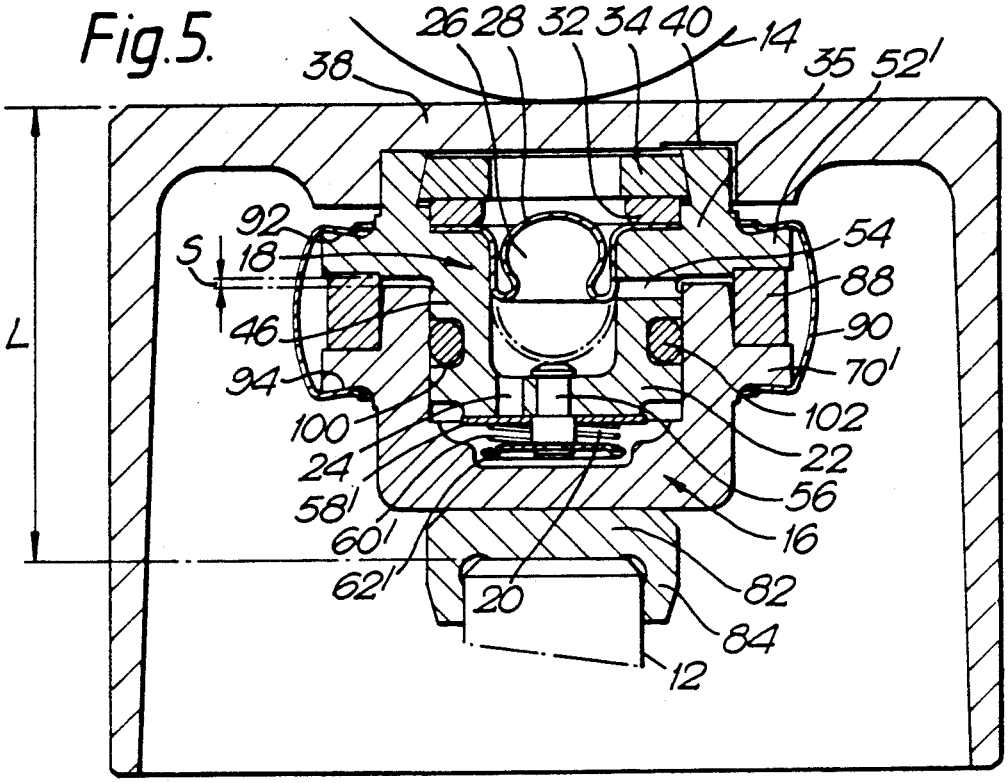
FIG. 5 shows a side view in cross-section of a third embodiment of the present invention.

The valve-lash adjustment system 10 is installed on the respective valve of the motor vehicle engine in the same way as the valve adjusters of the prior art with the exception that, for the embodiments shown in FIG. 1, 3 and 5, prior to installing the hydraulic part of the lash adjustment system, a shim 82 must be positioned on the free end of the engine valve. The thickness of this shim 82 is to be determined prior to its installation. With the valve-lash adjuster assembly in position, the first annular shoulder 50 of the piston 18 is spaced by a distance S from the first annular shoulder 68 of the cylinder body 16, and this distance S is substantially equivalent to the distance by which L diminishes as a result of the thermal expansion of the respective valve and associated movable cam surface when the motor vehicle engine reaches its maximum operating temperature. The distance S normally lies within the range of 0.1 to 0.3 mm.

The operation of the valve-lash adjustment system 10 shown in FIG. 1 will now be described from a beginning point at which the respective valve is in a closed position and a non-eccentric portion of the movable cam surface 14 is in contact with the contact surface 44 of tappet housing 38. At this beginning point, the piston 18 is urged away from cylinder body 16 by the spring chamber arrangement 72, the hydraulic pressures present in the high-pressure chamber 20 and the low-pressure chamber 26 are substantially the same, and through passage 24 is closed by the plate valve 58. As the movable cam surface 14 moves towards the position in which an eccentric portion of the surface comes into wiping contact with the contact surface 44, it produces a downward thrust upon the tappet housing 38 which is transmitted directly to piston 18. Piston 18 attempts to move downwardly within cylinder body 16, but is prevented from doing so to any extent by the closed plate valve 58 preventing flow of hydraulic fluid from the high-pressure chamber 20 to the low-pressure chamber 26. Consequently, the downward thrust on piston 18 is transmitted to cylinder body 16, and thence to the free end 12 of the valve stem of the respective valve through the intervening shim 82. This downward thrust increases until it is sufficient to overcome the spring bias exerted on the respective valve, and then the respective valve moves to its open position.

While the respective valve is in its open position, the hydraulic fluid trapped in high-pressure chamber 20 gradually begins to leak back (i.e. to "leak-down") to the low-pressure chamber 26 through the clearance between the piston 18 and the bore 48, returning via the passage 54. This "leak-down" effect causes a slight collapse in the valve-lash adjuster assembly to occur while the respective valve is in its open position. Upon the movable cam surface 14 moving to a position in which a non-eccentric portion of the cam surface 14 is in wiping contact with the contact surface 44 of the tappet housing 38, the downward thrust exerted on the respective valve disappears, so allowing movement of the respective valve to its closed position under the spring bias exerted on that valve. The consequential upward movement of the free end 12 of the valve stem moves both shim 82 and the valve-lash adjuster assembly upwards until the respective valve reaches its closed position. During this upward movement, movement can take place between the cylinder body 16 and the piston 18, and this movement is effected by the expansion of the spring chamber arrangement 72 moving the piston 18 upwards in cylinder body 16. This upward movement reduces the pressure in high-pressure chamber 20, which results in the plate valve 58 opening under the pressure imbalance between high-pressure chamber 20 and low-pressure chamber 26, thus allowing hydraulic fluid to flow from low-pressure chamber 26 to high-pressure chamber 20 via passage 24, to replenish the hydraulic fluid retained in high-pressure chamber 20. Once the valve-lash adjuster assembly has expanded to the extent that contact surface 44 of tappet housing is firmly in wiping contact with the movable cam surface 14, the pressures in chambers 20 and 26 substantially equalize, and plate valve 58 closes again, ready for the cycle of operation to repeat itself.

It will be appreciated by a man skilled in the art that combining a hydraulic valve-lash adjuster assembly with a shim adjustment for mechanical tolerance present between the respective valve and the movable cam surface 14 results in the degree of self-adjustment of length in the hydraulic valve-lash adjuster assembly being substantially reduced to that required primarily to compensate for thermal expansion effects between the respective valve and the movable cam surface 14. This means that the degree of flexure in the spring chamber arrangement 72 is markedly reduced, along with the quantity of hydraulic fluid which needs to be shuttled backwards and forwards between the high-pressure chamber 20 and the low-pressure chamber 26. This in turn means that the flexible diaphragm 28 is not required to undergo extensive flexure and/or stretching during the operation of the valve-lash adjustment system of the invention, thus increasing the working life of the system.

Moreover, in the unlikely event of the failure of the hydraulic valve-lash adjuster assembly due to loss of hydraulic fluid via leakage or failure of flexible diaphragm 28, the hydraulic valve-lash adjuster assembly will only collapse until the first annular shoulder 50 on piston 18 comes into contact with the first annular shoulder 68 on cylinder body 16. Once this happens the valve-lash adjustment system functions like a solid body between the movable cam surface 14 and the free end 12 of the valve stem of the respective valve. Since the extent to which the hydraulic valve-lash adjuster assembly can collapse under failure is of the order of 0.1 to 0.3 mm, the motor vehicle engine can still operate without undue problems until the faulty hydraulic valve-lash adjuster assembly can be replaced. There will, of course, be an increase in mechanical tappet noise with such a faulty unit in place, but this is useful in indicating that the system includes a faulty unit which needs replacing. There is not the risk, found with conventional hydraulic valve-lash adjusters operating over an adjustment range of the order of 2 mm, that the valve train of the motor vehicle engine may undergo substantial damage and possible failure as a result of the failure of the hydraulic valve-lash adjuster. Similarly, when the engine is stationary for any protracted time, any engine valve that is in the open position tends to close under the spring bias exerted on that valve and hydraulic fluid trapped in the high-pressure chamber will gradually leak back to the low-pressure chamber. The valve-lash adjustment system will however only collapse until shoulder 50 comes in contact with shoulder 68. The extent of this collapse being of the order of 0.1 to 0.3 mm, the time to refill the high-pressure chamber will be greatly reduced.

The above mentioned properties of the hydraulic valve-lash adjustment system shown in FIG. 1 will lead to substantially total compensation for valve lash as soon a the engine is started.

Figure 2:
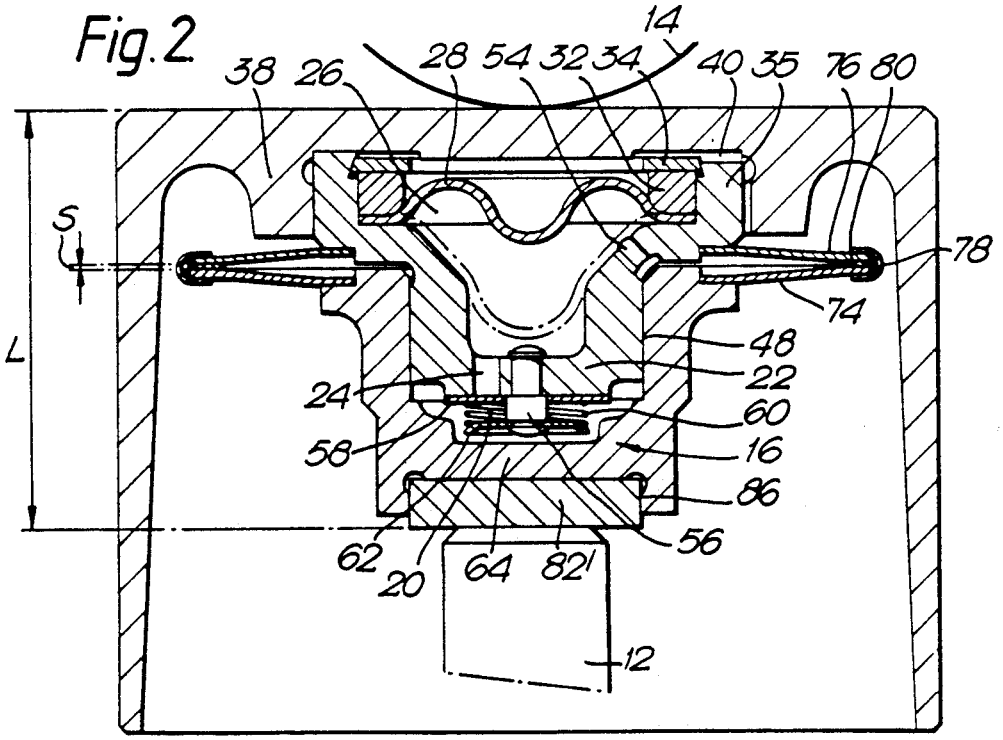
FIG. 2 shows a side view in cross-section of a preferred modification of the embodiment shown in FIG. 1.

Turning now to FIG. 2 of the accompanying drawings, this illustrates a preferred modification of the valve-lash adjustment system shown in FIG. 1. Like reference numerals are used in FIG. 2 to indicate like features shown in FIG. 1. The construction and operation of the modification shown in FIG. 2 are the same as for FIG. 1, with the exception that the load-carrying spacer means comprises a hardened planar shim 82' of the correct thickness to compensate for the aforesaid mechanical tolerance, which shim 82' is retained within a cylindrical cavity 86 in the base portion 64 of the cylinder body 16. This modification of the system means that it is a simpler procedure to install the shim 82' of the correct thickness into position in the base portion 64 of the cylinder body 16 prior to the installation of the complete system as a unit between the free end 12 of the valve stem of the respective valve and the movable cam surface 14. It is also a simpler and cheaper way of providing a series of hardened shims 82' of varying thicknesses ranging from 1 to 3 mm in steps of 0.5 mm for use in this way.

FIG. 3 of the accompanying drawings illustrates a second embodiment of the present invention in which the spring chamber arrangement 72 of FIG. 1 is replaced by a resilient biasing means between the piston 18 and the cylinder body 16 of the hydraulic valve-lash adjuster assembly which is positioned outside said variable-volume high-pressure chamber 20 and forms part of said low-pressure chamber 26. Like reference numerals are used in FIG. 3 to indicate like features shown in FIG. 1. In FIG. 3, the spring chambers arrangement 72 of FIG. 1 is replaced by a resilient elastomeric annular ring 88 positioned in sealing engagement with respective opposed annular shoulders 52' and 70' formed on the piston 18 and the cylinder body 16, and retained therein by a plurality of spring retainer clips 90 spaced circumferentially around said annular ring 88 and engaging respective annular abutments 92 and 94 formed on the piston 18 and the cylinder body 16. The annular plate valve 58 of FIG. 1 is replaced by a ball valve 96 which is retained in position within the high-pressure chamber 20 by means of a coil return spring 60' and a ball retainer cage 98. The operation of this second embodiment of the invention is exactly the same as the operation of the embodiment of the invention shown in FIG. 1. This second embodiment of the invention is an improvement over the embodiment shown in FIG. 1, in the sense that the hydraulic valve-lash adjuster assembly is easier to manufacture.

Figure 4:
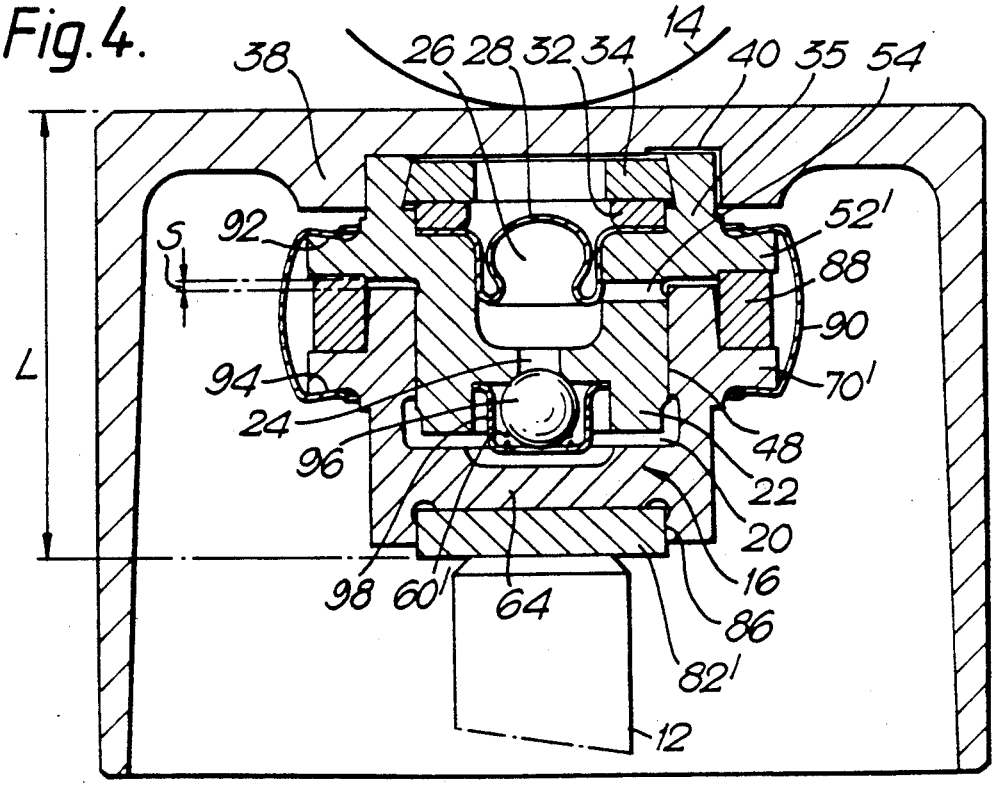
FIG. 4 shows a side view in cross-section of a preferred modification of the second embodiment shown in FIG. 3.

FIG. 4 of the accompanying drawings illustrates a preferred modification of the valve-lash adjustment system shown in FIG. 3. Like reference numerals are used in FIG. 4 to indicate like features shown in FIG. 3. The construction and operation of the modification shown in FIG. 4 are the same as for FIG. 3, with the exception that the load-carrying spacer means comprises a hardened planar shim 82' of the correct thickness to compensate for the aforesaid mechanical tolerance, which shim 82' is retained within a cylindrical cavity 86 in the base portion 64 of the cylinder body 16. This modification of the system means that it is a simpler procedure to install the shim 82' of the correct thickness into position in the base portion 64 of the cylinder body 16 prior to the installation of the complete system as a unit between the free end 12 of the valve stem of the respective valve and the movable cam surface 14. It is also a simpler and cheaper way of providing a series of hardened shims 82' of varying thicknesses ranging from 1 to 3 mm in steps of 0.05 mm for use in this way.

Turning now to FIG. 5 of the accompanying drawings, this illustrates a third embodiment of the present invention in which the ball valve 96 of FIG. 3 is replaced by an annular plate valve 58' similar to the annular plate valve 58 of FIG. 1. Like reference numerals are used in FIG. 5 to indicate like features shown in FIG. 3. As in the embodiment shown in FIG. 1, the annular plate valve 58' is spring-biased into contact with the base portion 22 of the piston 18 by means of a coil spring 60' which encircles guide post 56 and is retained thereon by means of an annular spring retainer 62' secured to the free end of guide post 56. Annular plate valve 58', when in contact with the base portion 22, substantially seals passage 24, and thus acts as a one-way valve between high-pressure chamber 20 and low-pressure chamber 26, but is provided with a predetermined clearance zone (not shown) which ensures that a major portion of the desired "leak-down" of hydraulic fluid from the high-pressure chamber 20 to the low-pressure chamber 26 occurs through this clearance zone and through passage 24. This is because the mid-section 46 of the piston 18 is provided with an annular groove 100 containing a seal 102 which forms a sliding seal between the piston 18 and the bore 48 in cylinder body 16, and sharply restricts the quantity of "leak-down" hydraulic fluid occurring between the piston 18 and the bore 48. This arrangement avoids the need for close-tolerance fits between the piston 18 and bore 48 in cylinder body 16 as shown in FIG. 1. The operation of this third embodiment of the invention is exactly the same as the operation of the embodiment of the invention shown in FIG. 1.

Figure 6:
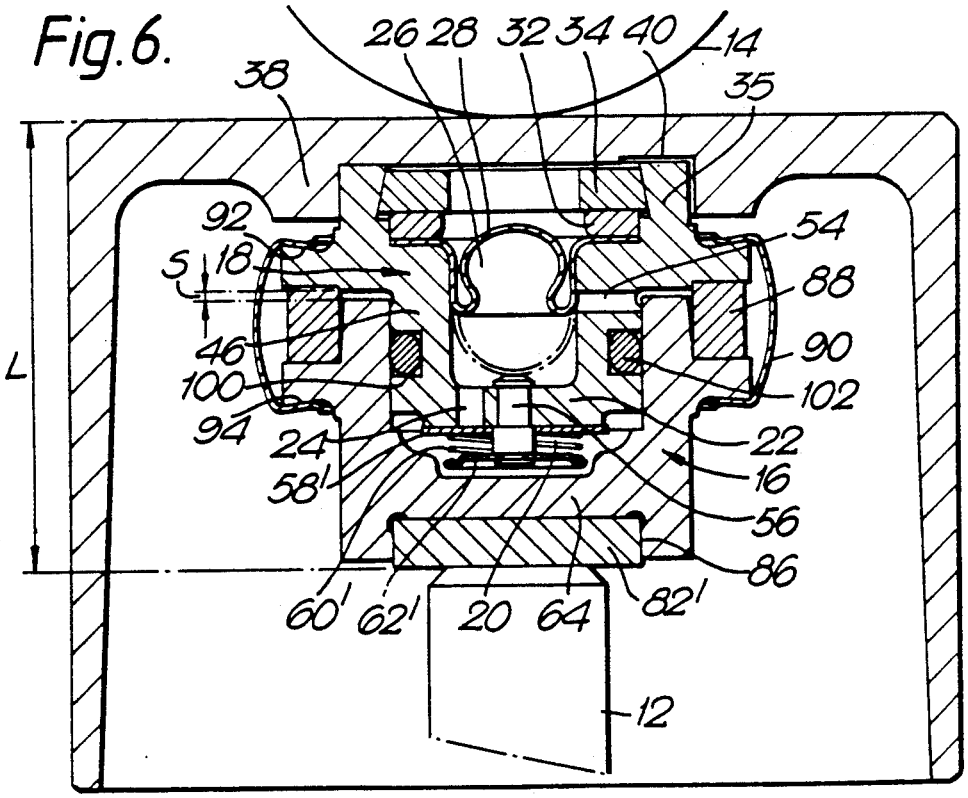
FIG. 6 shows a side view in cross-section of a preferred modification of the embodiment shown in FIG. 5.

FIG. 6 of the accompanying drawings illustrates a preferred modification of the valve-lash adjustment system shown in FIG. 5. Like reference numerals are used in FIG. 6 to indicate like features shown in FIG. 5. The construction and operation of the modification shown in FIG. 6 are the same as for FIG. 5, with the exception that the load-carrying spacer means comprises a hardened planar shim 82' of the correct thickness to compensate for the aforesaid mechanical tolerance, which shim 82' is retained within a cylindrical cavity 86 in the base portion 64 of the cylinder body 16. This modification of the system means that it is a simpler procedure to install the shim 82' of the correct thickness into position in the base portion 64 of the cylinder body 16 prior to the installation of the complete system as a unit between the free end 12 of the valve stem of the respective valve and the movable cam surface 14. It is also a simpler and cheaper way of providing a series of hardened shims 82' of varying thicknesses ranging from 1 to 3 mm in steps of 0.05 mm for use in this way.

The present invention provides a novel and unobvious means of overcoming mechanical valve noise sometimes produced during the cold starting of motor vehicle engines that utilize known hydraulic valve-lash adjusters, particularly known hydraulic valve-lash adjusters obtaining the hydraulic fluid therefor from the engine lubrication system. It comprises a combination of a load-carrying spacer means to compensate for the manufacturing tolerances in those parts of a motor vehicle engine that relate to lash in a valve train of that engine, along with a compact hydraulic valve-lash adjuster assembly of novel design to compensate for the thermal expansion and contraction of the components of said valve train. Since the compact hydraulic valve-lash adjuster assembly of the present invention only has to compensate for thermal expansion/contraction dimensional changes amounting to a few tenths of a millimeter, advantages are obtained which are not feasible with known prior-art hydraulic valve-lash adjusters.

One such advantage is that the "dry lash" (the total travel of piston 18 within cylinder body 16 with the system 10 installed in an engine but with no hydraulic fluid present in the high-pressure chamber 20) would amount only to 0.1 to 0.3 mm, which is chosen to be equivalent to the valve lash that the engine would have if it were designed to operate with solid lash compensation as opposed to hydraulic, self-adjusting lash compensation. Consequently, should there be no hydraulic fluid in high-pressure chamber 20 as a result of a broken seal in the hydraulic valve-lash adjuster assembly, or because the engine has been shut down for a protracted period, the engine, when operated, will continue to operate as if it were designed for solid lash adjustment.

Another advantage is that the cold start properties of the engine are improved, since the valve-lash adjustment system of the invention gives effectively total compensation for valve lash as soon as the engine is started.

A further advantage of the valve-lash adjustment system of the invention is that the hydraulic valve-lash adjuster assembly is much smaller than known prior-art hydraulic valve-lash adjusters, and requires the use of a much smaller quantity of hydraulic fluid in order to function. The hydraulic valve-lash adjuster assembly used in the system of the present invention has the marked advantage over other known prior-art self-contained hydraulic valve-lash adjusters that it does not have the need to store and displace substantial quantities of hydraulic fluid during operation, and thus does not need to include flexible reservoirs or pressure-compensating diaphragms therein which are subjected to substantial wear and distortion during the service life of the adjuster.

I claim:

1. A valve-lash adjustment system for use in a motor vehicle engine which is designed to be positioned between a free end of a valve stem of a spring-loaded valve of the engine and a movable cam surface so as to compensate, when the engine is operating, for any valve lash generated between said valve and said movable cam surface due to thermal expansion/contraction and/or mechanical tolerances between said valve and associated engine components, wherein said system includes a hydraulic valve-lash adjuster assembly which comprises a reciprocably movable cylinder body, a piston slidably mounted in said cylinder body to define therebetween a high-pressure, variable-volume chamber filled with hydraulic fluid, a resilient biasing means which biases said piston away from said cylinder body, and a one-way valve-controlled passage in said piston connecting said high-pressure chamber to a low-pressure chamber which contains hydraulic fluid and is located within a tappet housing, which tappet housing contains said hydraulic valve-lash adjuster assembly and includes a contact surface engageable with said movable cam surface, said hydraulic valve-lash adjuster assembly being capable of adjusting the overall length thereof during engine operation to substantially eliminate said valve lash, the valve-lash adjustment system including a load-carrying spacer means adjacent the hydraulic valve-lash adjuster assembly which is interposed between said hydraulic valve-lash adjuster assembly and either said free end of the valve stem or said movable cam surface, the thickness of said load-carrying spacer means being such as to compensate substantially for said mechanical tolerances between said valve and said associated engine components, so that, during engine operation, said hydraulic valve-lash adjuster assembly adjusts the overall length thereof within a limited range of distances required to compensate for said thermal expansion/contraction between the valve and said associated engine components, and, in the event of a failure in supply of hydraulic fluid to said hydraulic valve-lash adjuster assembly, said hydraulic valve-lash adjuster assembly will only decrease in overall length by an amount falling within said limited range of distances.

2. A valve-lash adjustment system according to claim 1, in which said load-carrying spacer means comprises a metal shim which is inserted between said hydraulic valve-lash adjuster assembly and said free end of the valve stem.

3. A valve-lash adjustment system according to claim 1, in which the thickness of the load-carrying spacer means is in the range of 1 to 3 mm., and said limited range of distances through which the hydraulic valve-lash adjuster assembly operates is 0.1 to 0.3 mm.

4. A valve-lash adjustment system according to claim 3, in which the hydraulic valve-lash adjuster assembly comprises a self-contained hydraulic valve-lash adjuster assembly in which said low-pressure chamber in the tappet housing is a variable-volume sealed chamber filled with hydraulic fluid.

5. A valve-lash adjustment system according to claim 4, in which the resilient biasing means between the piston and the cylinder body of the hydraulic valve-lash adjuster assembly is positioned outside said variable-volume high-pressure chamber and forms part of said low-pressure chamber.

6. A valve-lash adjustment system according to claim 5, in which the resilient biasing means comprises a spring chambers formed from two Belleville springs arranged in opposition to one another with the outer peripheries thereof sealed to one another.

7. A valve-lash adjustment system according to claim 5, in which the resilient biasing means comprises a resilient elastomeric annular ring positioned in sealing engagement with respective opposed surfaces formed on said piston and said cylinder body, and retained therein by a plurality of spring retainer clips spaced circumferentially around said annular ring and engaging respective abutments formed on said piston and said cylinder body.

8. A valve-lash adjustment system according to claim 4, in which the one-way valve in the hydraulic valve-lash adjuster assembly is a ball valve.

9. A valve-lash adjustment system according to claim 4, in which the one-way valve in the hydraulic valve-lash adjuster assembly is a plate valve.

10. A valve-lash adjustment system according to claim 9, in which the plate valve is slidably mounted for reciprocal movement on a central guide post which extends perpendicular to a flat surface of the plate valve, said guide post being mounted within said variable-volume high-pressure chamber.

11. A valve-lash adjustment system for use in a motor vehicle engine which is designed to be operatively positioned between a free end of a valve stem of a spring-loaded valve of the engine and a movable cam surface so as to compensate, when the engine is operating, for any valve lash generated between said valve and said movable cam surface due to thermal expansion/contraction and/or mechanical tolerances between said valve and associated engine components, includes a hydraulic valve-lash adjuster assembly which comprises a reciprocably movable cylinder body, a piston slidably mounted in said cylinder body to define therebetween a high-pressure, variable-volume chamber filled with hydraulic fluid, a resilient biasing means which biases said piston away from said cylinder body, and a one-way valve-controlled passage in said piston connecting said high-pressure chamber to a low-pressure chamber which contains hydraulic fluid, said hydraulic valve-lash adjuster assembly being capable of adjusting the overall length thereof during engine operation to substantially eliminate said valve lash, the valve-lash adjustment system including a load-carrying spacer means adjacent the hydraulic valve-lash adjuster assembly which is operatively interposed between said hydraulic valve-lash adjuster assembly and one of said free end of the valve stem and said movable cam surface, the thickness of said load-carrying spacer means being such as to compensate substantially for said mechanical tolerances between said valve and said associated engine components, so that, during engine operation, said hydraulic valve-lash adjuster assembly adjusts the overall length thereof within a limited range of distances required to compensate for said thermal expansion/contraction between the valve and said associated engine components, and, in the event of a loss of hydraulic fluid in said hydraulic valve-lash adjuster assembly, said hydraulic valve-lash adjuster assembly will only decrease in overall length by an amount falling within said limited range of distances.

12. A hydraulic-lash adjuster for use in a motor vehicle engine operatively positioned between a free end of a valve stem of a spring-loaded valve of the engine and a movable cam surface so as to compensate, when the engine is operating, for valve lash between said valve and said movable cam surface said hydraulic valve-lash adjuster being self-contained and comprising an axially reciprocably movable cylinder body, a piston slidably mounted in said cylinder body to define therebetween a high-pressure, variable-volume chamber filled with hydraulic fluid, a resilient biasing means which biases said piston away from said cylinder body, and a one-way valve-controlled passage in said piston connecting said high-pressure chamber to a variable-volume sealed low-pressure chamber which contains hydraulic fluid, the resilient biasing means forming part of said low-pressure chamber and positioned outside said variable-volume high-pressure chamber in sealing engagement with respective axially opposed surfaces formed on said piston and said cylinder body, said hydraulic valve-lash adjuster assembly being capable of adjusting the overall length thereof during engine operation to substantially eliminate at least a portion of said valve lash.

13. A hydraulic valve-lash adjuster according to claim 12, in which the resilient biasing means comprises a spring chamber formed from two Belleville springs arranged in opposition to one another with the outer peripheries thereof sealed to one another.

14. A hydraulic valve-lash adjuster according to claim 12, in which the resilient biasing means comprises a resilient elastomeric annular ring retained by a plurality of spring retainer clips spaced circumferentially around said annular ring and engaging respective abutments formed on said piston and said cylinder body.

15. A hydraulic valve-lash adjuster according to claim 12, in which the one-way valve is a ball valve.

16. A hydraulic valve-lash adjuster according to claim 16, in which the one-way valve is a plate valve.

17. A hydraulic valve-lash adjuster according to claim 16 in which the plate valve is slidably mounted for reciprocal movement on a central guide post which extends perpendicular to a flat surface of the plate valve, said guide post being mounted within said variable-volume high-pressure chamber.

* * * * *